US005794304A

United States Patent [19]

Ritter

[11] Patent Number: 5,794,304

[45] Date of Patent: Aug. 18, 1998

[54] SWEEPING MACHINE WITH DUST EXTRACTION

[75] Inventor: Eberhard Ritter, Berlin, Germany

[73] Assignee: Het Haller Entwicklungs Und Technologiegesellsaaft MbH & Co., Germany

[21] Appl. No.: 571,226

[22] Filed: Dec. 12, 1995

[51] Int. Cl.[6] ..... E01H 1/08

[52] U.S. Cl. ..... 15/346; 15/340.3; 15/421

[58] Field of Search ..... 15/340.1, 340.3, 15/340.4, 346, 421, 331

[56] References Cited

U.S. PATENT DOCUMENTS 4,109,341 8/1978 Larsen et al. .

FOREIGN PATENT DOCUMENTS 0 261 553 9/1987 European Pat. Off. .
0 621 376 A1 3/1994 European Pat. Off. .
0 443 882 B1 5/1996 European Pat. Off. .
34 42 602 C1 11/1984 Germany .
40 01 088 A1 1/1990 Germany .
90 17 025.3 12/1990 Germany .
91 00 929.4 1/1991 Germany .
41 21 592 C1 6/1991 Germany .
94 09 086.6 7/1994 Germany .
1 369 426 10/1974 United Kingdom .
81/01362 5/1981 WIPO .
86/07551 12/1986 WIPO .

*Primary Examiner*—Chris K. Moore
*Attorney, Agent, or Firm*—Cesari and McKenna, LLP

[57] ABSTRACT

A sweeping vehicle for pneumatic take-up of refuse, include a suction mouthpiece, connected via a first suction line with a refuse container. In order to ensure effective dust removal at the lateral broom independently of the time of year and without use of water, at least on ejector nozzle is provided, whose suction opening is disposed in the suction air intake area of the suction mouthpiece, and which may be connected to a second suction line.

7 Claims, 3 Drawing Sheets

SWEEPING MACHINE WITH DUST EXTRACTION

BACKGROUND OF THE INVENTION

The invention relates to a sweeping machine for pneumatic removal of refuse, with a suction mouthpiece connected by a first suction line to a refuse container.

Sweeping vehicles of this type are known and operate on the principle of vacuum refuse removal. Thus the refuse to be removed from the surface to be cleaned is conveyed into the refuse container by means of a suction airflow generated by a vacuum blower and passed through a correspondingly designed suction mouthpiece and through a first suction line into the refuse container. There the refuse is, for example, separated by gravitational precipitation from the airflow.

However, the separation of fine dust in such sweeping vehicles is problematic, as the large amount of conveyed air itself leads in large cross-sections of airlines of components to such high flow speeds that fine dust is carried along. This problem is partly countered by wetted dust removal, the fine dust being bound with water by wetting the refuse. The disadvantages of such wet dust removal however, lie in the higher costs, the space required on the sweeping vehicle for the water (thus possible restricting the size of refuse the container), and in the fact that wet dust removal is not usable when there is a risk of frost.

There is known from DE 40 01 088, a sweeping vehicle for pneumatic removal of refuse by means of a suction mouthpiece, in which the dust-laden air from the suction blower is, to a large extent, again passed to the suction mouthpiece in a circulating air process as blown air. This solution has proved unsatisfactory in practice.

A dry sweeping vehicle is known from DE 43 30 233, in which large-dimension dry filters are used for exhaust air cleaning. These however merely solve the problem of dust removal from exhaust air in an all-year-round manner. In the sweeping vehicle disclosed in this document, the disadvantage remains that dust removal at the lateral or sweeping brooms in a dry process is again only possible by means of the use of water, which excludes operation during frost risk.

Moreover, solutions are known in practice but without documentary evidence, in which the refuse sweeping space beneath the vehicle is surrounded on all sides as closely as possible by flexible skirts, in order to prevent the emergence of dust and the entailed poluution of the environment. The disadvantages of this solution however reside in the fact that the sweeping broom and the suction mouthpiece can only be observed by the driver by means of a video device, and access to the components is rendered considerably more difficult.

Finally it is known to use small blowers for suction removal of the dust on the sweeping brooms, such as are in particular known in the case of mechanically-conveying sweeping machines, in conjunction with dry filters. the disadvantage of this solution resides in the increased technical outlay and the entailed increased costs and other side effects.

SUMMARY OF THE INVENTION

The purpose of the present invention is to avoid the described disadvantages and to provide a sweeping vehicle with a dust removal system at the sweeping or lateral brooms, which may be used independently of the time of year and without the use of water.

This purpose is fulfilled according to the invention by a sweeping vehicle with the features of the dependent claims herein.

By means of disposing an ejector nozzle with its suction opening in the conveyed air in-flow area of the suction mouthpiece it is possible, by using the pressure drop obtaining at that point and the ejector effect in terms of flow mechanics at the input of the nozzle, to generate in the second suction line a partial vacuum without using an additional blower and without impairing the intake performance of the sweeping vehicle. Thus the ejector effect is achieved by the fact that the conveyed air in the conveyed air in-flow area of the suction mouthpiece flows at a high speed past the suction opening of the suction nozzle, thus generating a partial vacuum in the intake nozzle, and thus also in the second suction line.

Preferred further developments of the invention are indicated in the secondary claims.

Preferably, the second suction line is in the form of a flexible hose, whose suctiojn end is connected to an output hood. The fine dust, for example taken up at a lateral broom by the suction output hood, is thus conveyed through the second suction line and the nozzle into the conveyed air in-flow area of the suction mouthpiece and thus likewise is passed to the refuse container. In conjunction with a dry filter for the exhaust air in which the dust whirled up at the lateral broom is also contained, the sweeping device so equipped may be used all the year round and may operate in a relatively dust-free manner.

Attached to the nozzle are flexible air-guiding strips and, in the portion of their length projecting over the edge of the suction opening, they are designed to be adjustable. By means of these air-guiding strips, the remaining slot between the lower edge of the air-guiding strips and the roadway may be altered, and thus also the flow rate of the conveyed air flowing into the suction mouthpiece, which in turn influences the strength of the described ejector effect.

In order to prevent damage to the intake device in the case of heavy-refuse, the air-guiding strips are slotted from below in the projecting region.

In order to avoid impairing the intake effect in the vacuum intake region of the suction mouthpiece and the drawing effect caused by the ejector effect in the nozzle, a resilient seal strip is preferably provided between the suction mouthpiece and the nozzle. If an adjustable flexible heavy-refuse flap is disposed in the direction of travel at the front on the suction mouthpiece, as is the case in the embodiment to be described hereinafter, the resilient seal strip sits between the heavy-refuse flap and the nozzle.

For various economic reasons, it can be advantageous if the suction mouthpiece and the nozzle form a single constructive unit.

In order further to increase the effectiveness of the sweeping vehicle, there is provided in the region of the lateral broom, a blower nozzle which is connected via a blower line to the pressure chamber of the suction blower of the sweeping vehicle, and is so disposed that the air emerging from the blower nozzle is directed on to the opening of the suction hood at the lateral broom. Thus the pressure energy of the exhaust air from the suction blower is utilized to reinforce the suction removal of the refuse at the lateral broom.

BRIEF DESCRIPTION OF THE DRAWINGS

A preferred embodiment of the invention will be explained in more detail below with reference to the following drawings, in which.

DESCRIPTION OF THE PREFERRED EMBODIMENTS

Figure 1:
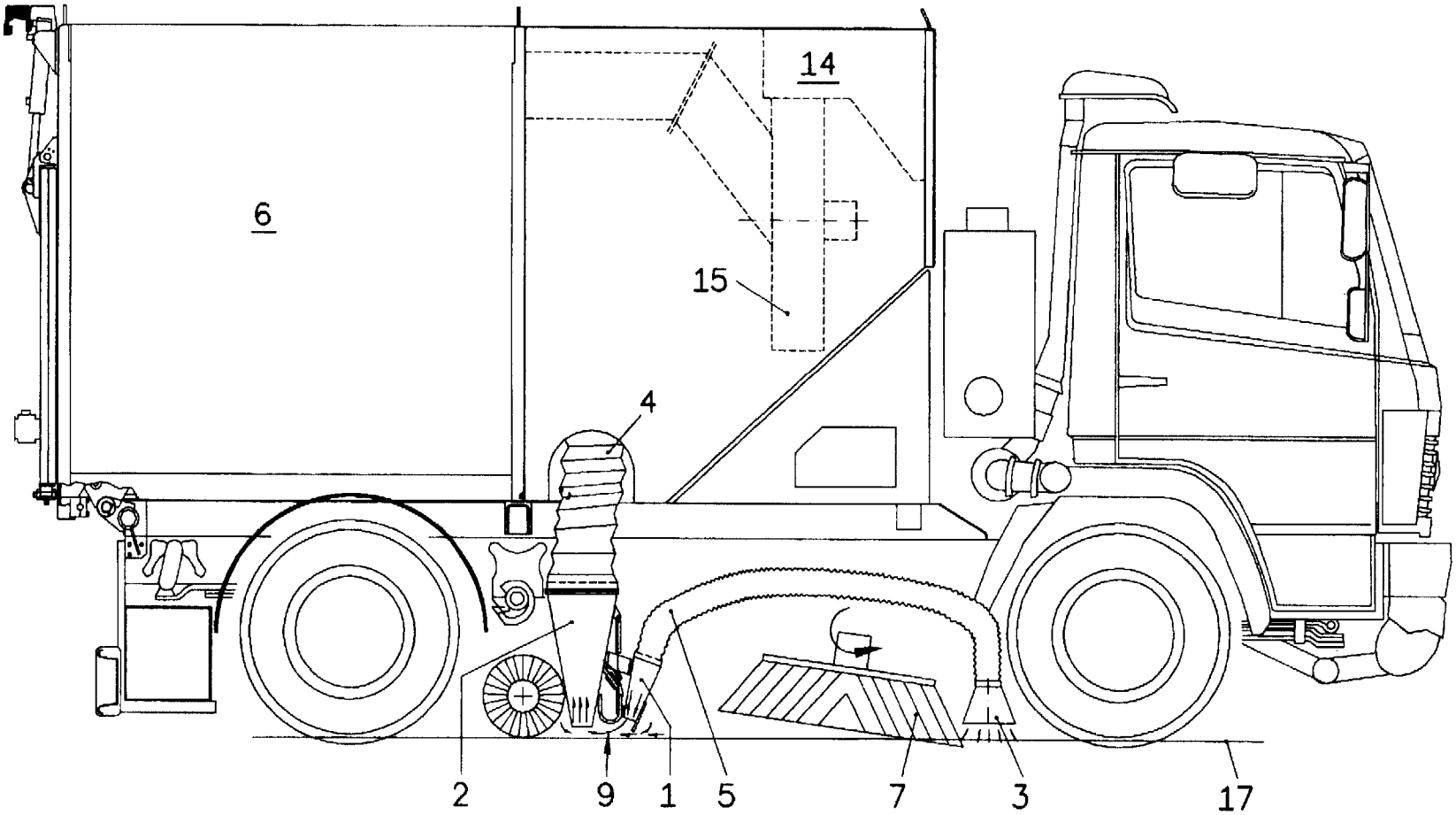
FIG. 1 is a diagrammatic side elevation of a sweeping vehicle with suction mouthpiece and a dust removal system at the lateral broom.

The sweeping vehicle shown in FIG. 1 for pneumatic removal of refuse has a custion blower 15 which generates, via the refuse container 6 and via a first suction line 4, the intake airflow between the lower end of the suction mouthpiece 2 and the roadway 17 necessary for conveyance of refuse. The space between the suction mouthpiece and the roadway is adjustable in a known way and is maintained by a support wheel (not shown).

The sweeping vehicle is also equipped with at least one lateral broom, 7, at which the whirled-up dust is taken in via an intake hood 3, a second, flexible suction line 5 and an ejector nozzle 1, and conveyed into the vacuum area of the suction mouthpiece 2.

Figure 2:
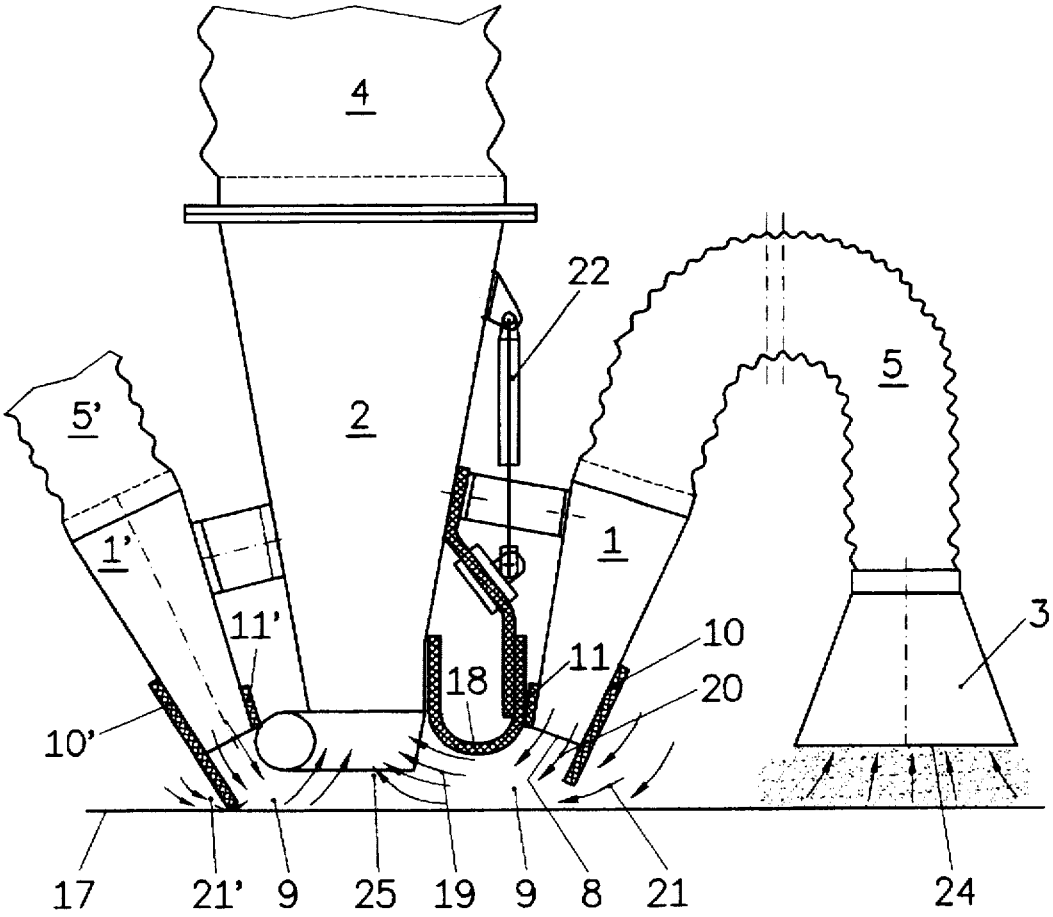
FIG. 2 is an enlarged view of the intake region of the suction mouthpiece and of the dust removal arrangement for the lateral broom.

FIG. 2 shows a diagrammatic detail of the intake area 9 and of the dust removal system at the lateral broom, which is, here, however, not shown for reasons of simplification. The suction mouthpiece 2 is fitted with a heavy-refuse flap 18, which is in the form of a flexible rolling flap, and may be moved up and down by means of a piston/cylinder unit 22. The suction mouthpiece 2 has a revolving opening 25 which favors the flow. In the suction area 9 of the suction mouthpiece 2, the main airflow 19, due to the static and dynamic partial vacuum obtaining at that point, is sharply accelerated and thus continuously sucks air out of the environment of the suction mouthpiece opening 25. On both sides of the suction mouthpiece 2 there is respectively attached an ejector nozzle 1, 1', whose suction opening 8 is disposed in the suction area 9 of the suction mouthpiece 2. These nozzles 1, 1' are respectively connected via a second, flexible suction line 5, 5' to an output hood 3 (hood 3' is not shown) for a lateral broom. On the side of the nozzle 1 facing away from the suction mouthpiece 2 there are attached flexible air-guiding strips 10, which are adjustable in the portion of their length projecting over the edge of the suction opening 8, and in this area are slotted from below. On the side of the nozzle 1 facing such a mouthpiece 2, there is provided between the heavy-refuse flap 18 and the nozzle 1 a resilient seal strip 11, which seals off the suction area 9 and thus prevents impairment of the suction performance. On the other side of the suction mouthpiece 2, i.e. behind in the direction of travel, no heavy-refuse flap is necessary, and thus the resilient seal strip 11' at that point is located directly between the nozzle 1' and the suction mouthpiece 2.

By means of disposing the nozzles 1, 1' in the suction area 9 of the suction mouthpiece 2, the main airflow 19 is divided up into partial airflows 20, 21, the partial airflow 20 in the nozzle 1 being reinforced by the ejector effect which is caused by the passage of the fast flowing partial air flow 21 past the lower edge of the air-guiding strips. Thus, there is generated in the nozzle 1, in the second, flexible suction line 5 and in the outlet hood 3, a partial vacuum which effectively withdraws the dust arising at the lateral broom 7 through the opening 24 in the suction hood 3. This suction effect according to the invention, due to the nozzle 1, may be even more advantageously utilized on the rear side of the suction mouthpiece 2, as at that point no heavy-refuse flap 18 is provided. Thus the effect of the pressure drop in the suction area 9 upon the nozzle 1' is substantially greater.

The resilient seal strip 11 ensures, in all positions of the heavy-refuse flap 18, and in all the working positions of the suction mouthpiece 2, a uniform function of the sweeping device and of the dust removal system.

Figure 3:
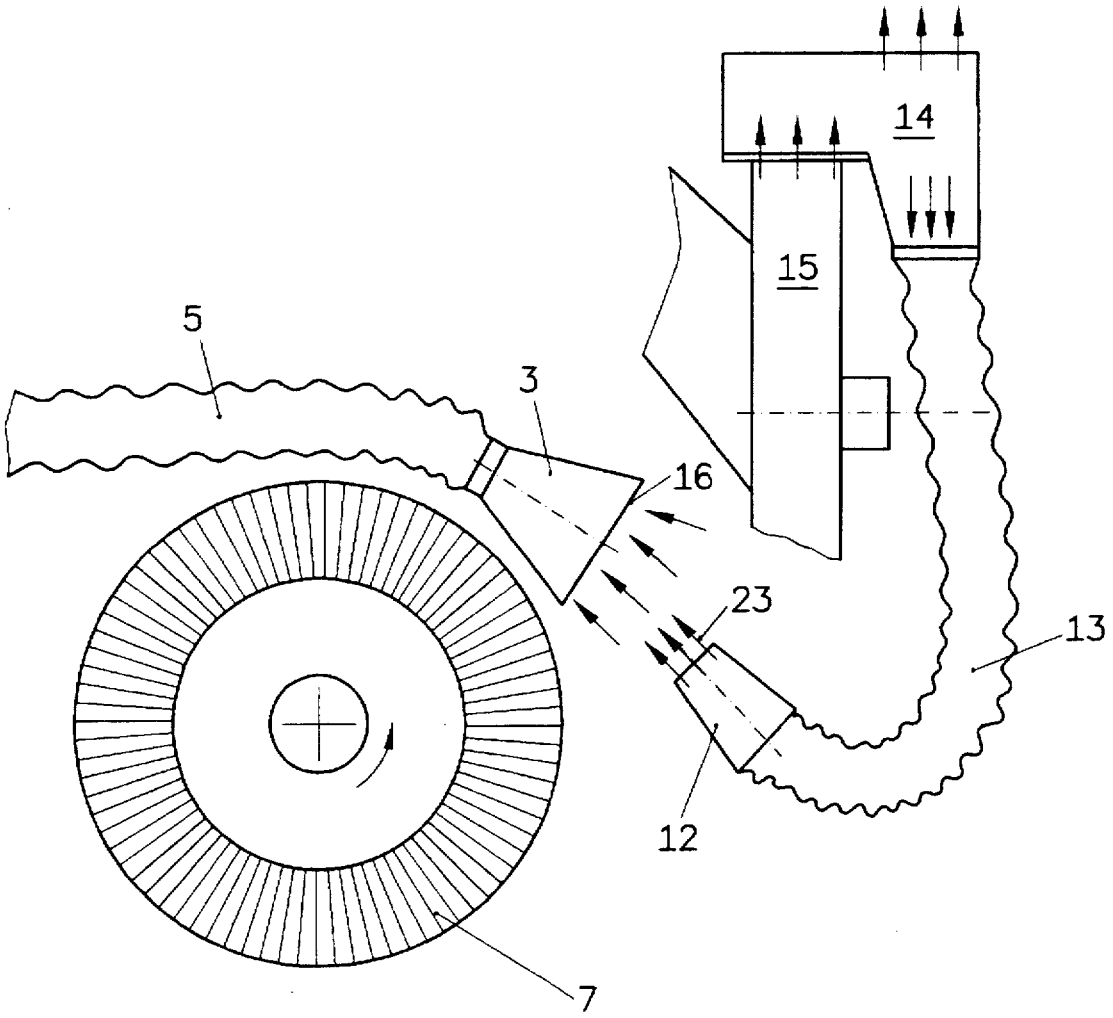
FIG. 3 is a diagrammatic plan view of the region around the lateral broom.

FIG. 3 shows a diagrammatic plan view of the area around the lateral broom 7. At this point there is provided a blower nozzle 12, which is connected via a blower line 13 with the pressure chamber 14 of the suction blower 15. The blower nozzle 12 is so disposed that the air 23 emerging from the blower nozzle 12 is directed at a further opening 16 in the suction hood 3, and thus reinforces the take-up of the dust whirled up by the lateral broom 7. For this purpose only a slight excess pressure is necessary in the blower line 13, and this may be simply generated in the pressure chamber 14 of the suction blower 15.

I claim:

1. A sweeping vehicl for pneumatically taking up refuse, including a suction mouthpiece (2) having a suction air intake area (9) and connected via a first suction line (4) to a mobile refuse container (6), and including a second suction line (5), connected at a suction end to a suction hood (3) at a lateral broom (7), and wherein air ejector nozzle (2) is connected to the other end of the second suction line (5), said ejector nozzle having a suction opening (8) disposed within the suction air intake area (9) of the suction mouthpiece (2).

2. A sweeping vehicle for pneumatically taking up refuse, including a suction mouthpiece (2) having a suction air intake area (9) and connected via a first suction line (4) to a mobile refuse container (6), and including at least one ejector nozzle (1) having a suction opening (8) disposed within the suction air intake area (9) of the suction mouthpiece (2), wherein a second suction line (5) is provided connected at one end to said ejector nozzle (1) and at the other end to a suction hood (3), and wherein flexible air guide strips (10) are attached to the ejector nozzle (1) and have portions projecting beyond the edge of the suction opening (8).

3. The sweeping vehicle according to claim 2 wherein said air guide strip portions are slotted from below.

4. The sweeping vehicle according to claim 1, wherein a resilient seal strip (11) is provided between the suction mouthpiece (2) and the ejector nozzle (1).

5. The sweeping vehicle according to claim 1, wherein the suction mouthpiece (2) and the ejector nozzle (1) form an integral unit.

6. The sweeping vehicle according to any one of claims 1, 4, or 5, wherein a blower nozzle (12) in the region of said lateral broom (7) is provided, which is connected via a blower line (13) with the pressure chamber (14) of a suction blower (15) and which is so disposed that the air (23) emerging from the blower nozzle (12) is directed onto the opening (16) of a suction hood (3).

7. The sweeping vehicle according to claim 1 or 2, wherein the second suction line (5) is a flexible hose.

* * * * *